US008828313B2

(12) United States Patent
Nemoto et al.

(10) Patent No.: US 8,828,313 B2
(45) Date of Patent: Sep. 9, 2014

(54) NI-BASE ALLOY FOR TURBINE ROTOR OF STEAM TURBINE AND TURBINE ROTOR OF STEAM TURBINE

(75) Inventors: Kuniyoshi Nemoto, Yokohama (JP); Kiyoshi Imai, Taito-ku (JP); Yomei Yoshioka, Yokohama (JP); Masayuki Yamada, Yokohama (JP); Reki Takaku, Yokohama (JP); Shigekazu Miyashita, Kawasaki (JP); Takeo Suga, Yokohama (JP); Takeo Takahashi, Yokohama (JP); Kenichi Okuno, Yokohama (JP); Akihiro Takakuwa, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 1289 days.

(21) Appl. No.: 12/403,884

(22) Filed: Mar. 13, 2009

(65) Prior Publication Data

US 2009/0285692 A1 Nov. 19, 2009

(30) Foreign Application Priority Data

Mar. 17, 2008 (JP) ..... 2008-067768

(51) Int. Cl.
*C22C 19/05* (2006.01)

(52) U.S. Cl.
USPC ..... 420/448; 420/450

(58) Field of Classification Search
CPC ..... C22C 19/05
USPC ..... 420/446, 448, 450; 148/428
See application file for complete search history.

(56) References Cited

U.S. PATENT DOCUMENTS

| | | | | |
|---|---|---|---|---|
| 3,707,409 | A | 12/1972 | Boesch et al. | |
| 3,785,876 | A | 1/1974 | Bailey | |
| 3,785,877 | A * | 1/1974 | Bailey | 148/556 |
| 5,372,662 | A | 12/1994 | Ganesan et al. | |
| 6,521,053 | B1 * | 2/2003 | Grylls et al. | 148/280 |
| 7,524,162 | B2 * | 4/2009 | Reigl | 415/104 |
| 2003/0185675 | A1 * | 10/2003 | Turnquist et al. | 415/178 |
| 2009/0074584 | A1 | 3/2009 | Nemoto et al. | |

FOREIGN PATENT DOCUMENTS

| | | | |
|---|---|---|---|
| EP | 0 633 325 | A1 | 1/1995 |
| EP | 0 849 370 | A1 | 6/1998 |
| EP | 2 039 789 | A1 | 3/2009 |
| FR | 1342426 | | 11/1963 |
| FR | 1343186 | | 11/1963 |
| JP | 7-150277 | | 6/1995 |
| JP | 2009-84684 | | 4/2009 |

OTHER PUBLICATIONS

Choudhury, I.A et al.., "Machinability of nickel-base super alloys: a general review", Journal of Materials Processing Technology, 77 (1998), pp. 278-284.*

Office Action issued Aug. 10, 2010 in Japanese Application No. 2008-067768 (With English Translation).

U.S. Appl. No. 12/633,273, filed Dec. 8, 2009, Nemoto, et al.

U.S. Appl. No. 12/633,468, filed Dec. 8, 2009, Nemoto, et al.

"JIS G 0567:1998, Method of elevated temperature tensile test for steels and heat-resisting alloys", Japanese Industrial Standard, 1998, 9 Pages.

U.S. Appl. No. 12/469,383, filed May 20, 2009, Yamada, et al.

U.S. Appl. No. 12/395,983, filed Mar. 2, 2009, Kubo, et al.

* cited by examiner

*Primary Examiner* — Jessee Roe

(74) *Attorney, Agent, or Firm* — Oblon, Spivak, McClelland, Maier & Neustadt, L.L.P.

(57) ABSTRACT

An Ni-base alloy for a turbine rotor of a steam turbine contains in percent by weight C: 0.01 to 0.15, Cr: 15 to 28, Co: 10 to 15, Mo: 8 to 12, Al: 1.5 to 2, Ti: 0.1 to 0.6, B: 0.001 to 0.006, Re: 0.5 to 3, and the balance of Ni and unavoidable impurities.

16 Claims, 1 Drawing Sheet

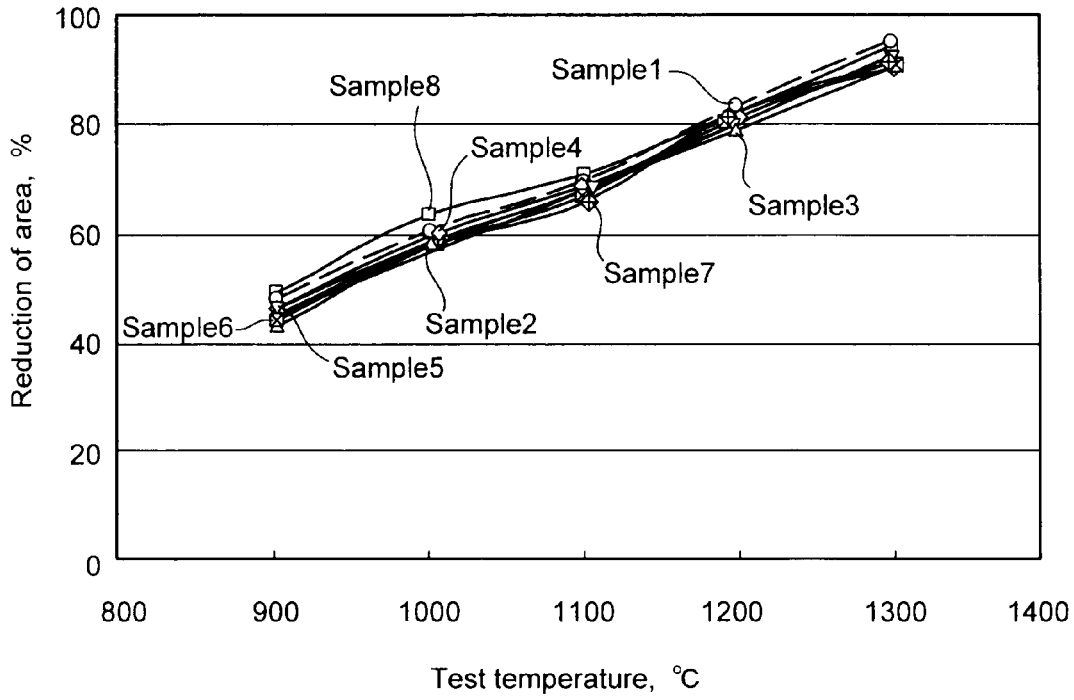
100
80
60
40
20
0
Reduction of area, %
800
900
1000
1100
1200
1300
1400
Test temperature, °C
Sample1
Sample2
Sample3
Sample4
Sample5
Sample6
Sample7
Sample8

NI-BASE ALLOY FOR TURBINE ROTOR OF STEAM TURBINE AND TURBINE ROTOR OF STEAM TURBINE

CROSS-REFERENCE TO RELATED APPLICATIONS

This application is based upon and claims the benefit of priority from the prior Japanese Patent Application No. 2008-067768 filed on Mar. 17, 2008; the entire contents of which are incorporated herein by reference.

BACKGROUND OF THE INVENTION

1. Field of the Invention

The present invention relates to a material configuring a turbine rotor of a steam turbine into which high-temperature steam flows as a working fluid, and more particularly to an Ni-base alloy for a turbine rotor of a steam turbine excelling in high-temperature strength and the like, and a turbine rotor of a steam turbine made of the Ni-base alloy.

2. Description of the Related Art

For a thermal power plant including a steam turbine, a technology for suppression of the emission of carbon dioxide is being watched with interest in view of the global environmental protection, and needs for highly efficient power generation are increasing.

To increase the power generation efficiency of the steam turbine, it is effective to raise the turbine steam temperature to a high level, and the recent thermal power plant having the steam turbine has its steam temperature raised to 600° C. or higher. There is a tendency that the steam temperature will be increased to 650° C., and further to 700° C. in future.

A turbine rotor, in which moving blades rotated by high-temperature steam are implanted, has a high temperature by circulation of high-temperature steam and generates a high stress by rotating. Therefore, the turbine rotor is required to withstand a high temperature and a high stress, and a material configuring the turbine rotor is demanded to have excellent strength, ductility and toughness in a range of room temperature to a high temperature.

Particularly, if the steam temperature exceeds 700° C., a conventional iron-based material is poor in high-temperature strength, so that the application of the Ni-base alloy is considered in for example JP-A 7-150277(KOKAI).

The Ni-base alloy has been applied extensively as a material mainly for jet engines and gas turbines because it is excellent in high-temperature strength and corrosion resistance. As its typical examples, Inconel 617 alloy (manufactured by Special Metals Corporation) and Inconel 706 alloy (manufactured by Special Metals Corporation) have been used.

As a mechanism to enhance the high-temperature strength of the Ni-base alloy, Al and Ti are added to secure the high-temperature strength by precipitating a precipitated phase called as a gamma prime phase ($Ni_3(Al, Ti)$) or a gamma double prime phase, or both of them within the mother phase material of the Ni-base alloy. For example, there is Inconel 706 alloy which secures high-temperature strength by precipitating both the gamma prime phase and the gamma double prime phase.

Meanwhile, the high-temperature strength of Inconel 617 alloy is secured by reinforcing (solid-solution strengthening) the mother phase of Ni group by adding Co and Mo.

As described above, it is being studied to apply the Ni-base alloy as a material for a turbine rotor of a steam turbine having a temperature exceeding 700° C., and it is also considered that its high-temperature strength can be improved further more.

And, the high-temperature strength of the Ni-base alloy is demanded to be improved by compositional modification or the like while maintaining the forgeability and weldability of the Ni-base alloy.

BRIEF SUMMARY OF THE INVENTION

Accordingly, the present invention provides an Ni-base alloy for a turbine rotor of a steam turbine that mechanical strength can be improved while maintaining workability such as forgeability, and a turbine rotor of a steam turbine.

According to an aspect of the invention, there is provided an Ni-base alloy for a turbine rotor of a steam turbine, which contains in percent by weight C: 0.01 to 0.15, Cr: 15 to 28, Co: 10 to 15, Mo: 8 to 12, Al: 1.5 to 2, Ti: 0.1 to 0.6, B: 0.001 to 0.006, Re: 0.5 to 3, and the balance of Ni and unavoidable impurities.

According to an aspect of the invention, there is also provided an Ni-base alloy for a turbine rotor of a steam turbine, which contains in percent by weight C: 0.01 to 0.15, Cr: 15 to 28, Co: 10 to 15, Mo: 8 to 12, Al: 1.5 to 2, Ti: 0.1 to 0.6, B: 0.001 to 0.006, Ta: 0.1 to 0.7, Re: 0.5 to 3, and the balance of Ni and unavoidable impurities.

According to an aspect of the invention, there is also provided an Ni-base alloy for a turbine rotor of a steam turbine, which contains in percent by weight C: 0.01 to 0.15, Cr: 15 to 28, Co: 10 to 15, Mo: 8 to 12, Al: 1.5 to 2, Ti: 0.1 to 0.6, B: 0.001 to 0.006, Nb: 0.05 to 0.35, Re: 0.5 to 3, and the balance of Ni and unavoidable impurities.

According to an aspect of the present invention, there is provided an Ni-base alloy for a turbine rotor of a steam turbine, which contains in percent by weight C: 0.01 to 0.15, Cr: 15 to 28, Co: 10 to 15, Mo: 8 to 12, Al: 1.5 to 2, Ti: 0.1 to 0.6, B: 0.001 to 0.006, Ta+2Nb (molar ratio of Ta to Nb of 1:2): 0.1 to 0.7, Re: 0.5 to 3, and the balance of Ni and unavoidable impurities.

According to an aspect of the invention, there is also provided a turbine rotor which is disposed through a steam turbine into which high-temperature steam is introduced, wherein at least a predetermined portion is formed of the Ni-base alloy for the turbine rotor of a steam turbine described above.

BRIEF DESCRIPTION OF THE DRAWINGS

The present invention is described with reference to the drawing, which is provided for illustration only and does not limit the present invention in any respect.

FIG. 1 is a diagram showing the results of Gleeble test on individual samples.

DETAILED DESCRIPTION OF THE INVENTION

Embodiments of the invention will be described below.

An Ni-base alloy for a turbine rotor of a steam turbine in an embodiment according to the present invention is composed of the compositional component ranges shown below. In the following description, percentages indicating the compositional components are by weight unless otherwise indicated.

(M1) Ni-base alloy which contains C: 0.01% to 0.15%, Cr: 15% to 28%, Co: 10% to 15%, Mo: 8% to 12%, Al: 1.5% to 2%, Ti: 0.1% to 0.6%, B: 0.001% to 0.006%, Re: 0.5% to 3%, and the balance of Ni and unavoidable impurities.

(M2) Ni-base alloy which contains C: 0.01% to 0.15%, Cr: 15% to 28%, Co: 10% to 15%, Mo: 8% to 12%, Al: 1.5% to 2%, Ti: 0.1% to 0.6%, B: 0.001% to 0.006%, Ta: 0.1% to 0.7%, Re: 0.5% to 3%, and the balance of Ni and unavoidable impurities.

(M3) Ni-base alloy which contains C: 0.01% to 0.15%, Cr: 15% to 28%, Co: 10% to 15%, Mo: 8% to 12%, Al: 1.5% to 2%, Ti: 0.1% to 0.6%, B: 0.001% to 0.006%, Nb: 0.05% to 0.35%, Re: 0.5% to 3%, and the balance of Ni and unavoidable impurities.

(M4) Ni-base alloy which contains C: 0.01% to 0.15%, Cr: 15% to 28%, Co: 10% to 15%, Mo: 8% to 12%, Al: 1.5% to 2%, Ti: 0.1% to 0.6%, B: 0.001% to 0.006%, Ta+2Nb: 0.1% to 0.7%, Re: 0.5% to 3%, and the balance of Ni and unavoidable impurities. "Ta+2Nb" indicates that a molar ratio of Ta to Nb is 1:2.

In the unavoidable impurities in the Ni-base alloys of the above (M1) to (M4), it is preferably suppressed that at least Si is 0.1% or less, and Mn is 0.1% or less.

The Ni-base alloys having the compositional component ranges described above are suitable as materials configuring a turbine rotor of a steam turbine which has a temperature in a range of 680 to 750° C. during its operation. All portions of the turbine rotor of the steam turbine may be made of the Ni-base alloy, and some portions, which have a particularly high temperature, of the turbine rotor of the steam turbine may be made of this Ni-base alloy. As some portions of the turbine rotor of the steam turbine which have a high temperature, there are specifically all regions of a high-pressure steam turbine section, or regions ranging from the high-pressure steam turbine section to some portions of an intermediate-pressure steam turbine section.

The Ni-base alloys of the compositional component ranges described above can improve mechanical strength including high-temperature strength while maintaining workability such as forgeability of a conventional Ni-base alloy. In other words, the Ni-base alloy is used to configure the turbine rotor of the steam turbine, so that the high-temperature strength of the turbine rotor can be improved, and the turbine rotor having high reliability in a high-temperature environment can be produced. And, when the turbine rotor of the steam turbine is manufactured, workability of a conventional Ni-base alloy can be maintained.

The reasons of limiting the individual compositional component ranges of the Ni-base alloy according to the present invention described above will be described below.

(1) C (Carbon)

C is useful as a component element of $M_{23}C_6$ type carbide which is a strengthening phase, and particularly, the creep strength of the alloy is maintained by precipitating the $M_{23}C_6$ type carbide during the operation of the steam turbine in a high-temperature environment of 650° C. or higher. It also has an effect of securing the fluidity of a molten metal at the time of casting. If the C content is less than 0.01%, a sufficient precipitation amount of carbide cannot be secured, so that mechanical strength is degraded, and the fluidity of the molten metal at the time of casting lowers considerably. Meanwhile, if the C content exceeds 0.15%, the tendency of segregation of components increases at the time of producing a large ingot, the generation of $M_6C$ type carbide which is an embrittlement phase is promoted, and mechanical strength is improved, but forgeability is degraded. Therefore, the C content is determined to be 0.01% to 0.15%.

(2) Cr (Chromium)

Cr is an indispensable element to improve oxidation resistance, corrosion resistance and mechanical strength of the Ni-base alloy. Besides, it is indispensable as a component element of the $M_{23}C_6$ type carbide, and particularly, the creep strength of the alloy is maintained by precipitating the $M_{23}C_6$ type carbide during the operation of the steam turbine in a high-temperature environment of 650° C. or higher. And, Cr improves the oxidation resistance in a high-temperature steam environment. If the Cr content is less than 15%, the oxidation resistance decreases. Meanwhile, if the Cr content exceeds 28%, precipitation of the $M_{23}C_6$ type carbide is accelerated considerably, resulting in increasing the tendency of coarsening. Therefore, the Cr content is determined to be 15% to 28%.

(3) Co (Cobalt)

In the Ni-base alloy, Co improves the mechanical strength of a mother phase by forming a solid solution in the mother phase. But, if the Co content exceeds 15%, an intermetallic compound phase which degrades the mechanical strength is generated, and forgeability is degraded. Meanwhile, if the Co content is less than 10%, workability is degraded, and the mechanical strength is lowered. Therefore, the Co content is determined to be 10% to 15%.

(4) Mo (Molybdenum)

Mo provides an effect of forming a solid solution into an Ni mother phase to enhance the mechanical strength of the mother phase, and its partial substitution in $M_{23}C_6$ type carbide enhances the stability of the carbide. If the Mo content is less than 8%, the above effect is not exerted, and if the Mo content exceeds 12%, a tendency of segregation of components increases when a large ingot is produced, and the generation of $M_6C$ type carbide which is an embrittlement phase is accelerated. Therefore, the Mo content is determined to be 8% to 12%.

(5) Al (Aluminum)

Al generates a γ' phase (gamma prime phase: $Ni_3Al$) together with Ni and improves the mechanical strength of the Ni-base alloy based on the precipitation. If the Al content is less than 1.5%, the mechanical strength is not improved in comparison with a conventional steel, and if the Al content exceeds 2%, the mechanical strength is improved, but forgeability is degraded. Therefore, the Al content is determined to be 1.5% to 2%.

(6) Ti (Titanium)

Similar to Al, Ti generates a γ' phase (gamma prime phase: $Ni_3Ti$) together with Ni and improves the mechanical strength of the Ni-base alloy. If the Ti content is less than 0.1%, the above effect is not exerted, and if the Ti content exceeds 0.6%, hot workability is degraded, and notch sensitivity becomes high. Therefore, the Ti content is determined to be 0.1% to 0.6%.

(7) B (Boron)

B segregates in the grain boundary to affect the high-temperature characteristics. And, B has an effect to improve the mechanical strength of an Ni mother phase by precipitating in the mother phase. If the B content is less than 0.001%, the effect to improve the mechanical strength of the mother phase is not exerted, and if the B content exceeds 0.006%, there is a possibility that the grain boundary is embrittled. Therefore, the B content is determined to be 0.001% to 0.006%.

(8) Re (Rhenium)

Re has an effect to improve the mechanical strength of an Ni mother phase by forming a solid solution in the mother phase. If the Re content is less than 0.5%, an effect to improve the mechanical strength of the mother phase is not exerted, and if the Re content exceeds 3%, a fragile phase is formed.

Therefore, the Re content is determined to be 0.5% to 3%. Similar to the Re, Co and Mo have an effect to improve the mechanical strength of the Ni mother phase by forming a solid solution in the mother phase. But, when the content is same, the Re is most excellent in improvement of the mechanical strength and can improve the mechanical strength without largely varying the chemical component composition of a base metal.

(9) Ta (Tantalum)

Ta forms a solid solution into a γ' phase (gamma prime phase: $Ni_3(Al, Ti)$) to enhance the strength and stabilizes precipitation strength. If the Ta content is less than 0.1%, no improvement is observed in the above effects in comparison with a conventional steel, and if the Ta content exceeds 0.7%, the mechanical strength is improved but forgeability is degraded. Therefore, the Ta content is determined to be 0.1% to 0.7%.

(10) Nb (Niobium)

Similar to the Ta, Nb forms a solid solution into a γ' phase (gamma prime phase: $Ni_3(Al, Ti)$) to enhance the strength and stabilizes precipitation strength. If the Nb content is less than 0.05%, no improvement is observed in the above effects in comparison with a conventional steel, and if the Nb content exceeds 0.35%, the mechanical strength is improved, but forgeability is degraded. Therefore, the Nb content is determined to be 0.05% to 0.35%.

When contained as a (Ta+2Nb) content in a range of 0.1% to 0.7%, both the above-described Ta and Nb form a solid solution into a γ' phase (gamma prime phase: $Ni_3(Al, Ti)$) to enhance the strength and improve the precipitation strength. If the (Ta+2Nb) content is less than 0.1%, no improvement is observed in the above effects in comparison with a conventional steel, and if the (Ta+2Nb) content exceeds 0.7%, the mechanical strength is improved, but forgeability is degraded. Ta and Nb are contained in at least 0.01% or more, respectively.

Since the specific gravity of Nb is about ½ of Ta (specific gravity of Ta: 16.6, specific gravity of Nb: 8.57), a solid solution amount can be increased by multiple addition of Ta and Nb in comparison with the addition of Ta alone. And, since Ta is a strategic material, its procurement is unstable, but Nb reserves are about 100 times larger than Ta, and Nb can be supplied stably. Ta has a melting point higher than that of Nb (Ta has a melting point of about 3000° C., Nb has a melting point of about 2470° C.), its γ' phase at a higher temperature is enhanced, and its oxidation resistance is superior to that of Nb.

(11) Si (Silicon), Mn (Manganese), Cu (Copper), Fe (Iron) and S (Sulfur)

Si, Mn, Cu, Fe and S are classified to unavoidable impurities in the Ni-base alloy according to the present invention. The residual contents of the unavoidable impurities are desirably decreased to 0%. And, it is desirable that at least Si and Mn in the unavoidable impurities are suppressed to 0.1% or below.

Si is added to the ordinary steel to supplement the corrosion resistance. But, since the Ni-base alloy has a large Cr content to secure sufficient corrosion resistance, a residual content of Si in the Ni-base alloy according to the present invention is determined to be 0.1% or less, and it is desirable that the residual content is reduced to 0% as much as possible.

In the ordinary steel, Mn prevents brittleness, which results from S (sulfur), in a form of MnS. But, since the S content in the Ni-base alloy is very small, it is not necessary to add Mn. Therefore, the residual content of Mn in the Ni-base alloy according to the present invention is determined to be 0.1% or below, and it is desirable that the residual content is reduced to 0% as much as possible.

The above-described Ni-base alloy according to the present invention is produced by melting the compositional components configuring the Ni-base alloy by a vacuum induction melting furnace, subjecting the obtained ingot to a soaking treatment, forging it, and conducting a solution treatment.

It is preferable that the soaking treatment is maintained at a temperature range of 1050 to 1250° C. for 5 to 72 hours, and the solution treatment is maintained at a temperature range of 1100 to 1200° C. for 4 to 5 hours. Here, the solution treatment temperature is determined to form a homogeneous solid solution of the γ' phase precipitates, and if the temperature is lower than 1100° C., a solid solution is not formed adequately. If the temperature exceeds 1200° C., crystal grains are coarsened and the strength is degraded. And, forging is performed at a temperature range of 950 to 1150° C.

In a case where the above-described Ni-base alloy according to the present invention is used to configure a turbine rotor of a steam turbine, for example, as one method (double melt), the raw material is subjected to vacuum induction melting (VIM) and electro-slag remelting (ESR) and then poured into a prescribed mold. Subsequently, a forging treatment and a heat treatment are performed to produce the turbine rotor. As another method (double melt), the raw material is subjected to vacuum induction melting (VIM) and vacuum arc remelting (VAR) and then poured into a prescribed mold. Subsequently, a forging treatment and a heat treatment are performed to produce the turbine rotor. As still another method (triple melt), the raw material is subjected to vacuum induction melting (VIM), electro-slag remelting (ESR) and vacuum arc remelting (VAR) and then poured into a prescribed mold. Subsequently, a forging treatment and a heat treatment are performed to produce the turbine rotor. The turbine rotors produced by the above methods are inspected by ultrasonic inspection or the like.

It is described below that the Ni-base alloy according to the present invention is excellent in mechanical strength and forgeability.

(Tensile Strength Test and Evaluation of Forgeability)

It is described below that the Ni-base alloy having the chemical composition ranges of the present invention has excellent mechanical strength and forgeability. Table 1 shows chemical compositions of Sample 1 to Sample 8 used for the tensile strength test and evaluation of forgeability. Sample 1 to Sample 7 are Ni-base alloys with the chemical composition ranges of the present invention, and Sample 8 is an Ni-base alloy with its composition not within the chemical composition ranges of the present invention and used as a comparative example. Sample 8 has a chemical composition corresponding to a conventional steel Inconel 617. The Ni-base alloy with the chemical composition ranges of the present invention contains Fe (iron), Cu (copper) and S (sulfur) as unavoidable impurities in addition to Si and Mn.

TABLE 1

| | | Ni | C | Si | Mn | Cr | Fe | Al | Mo | Co | Cu | Ti | B | S | Ta | Nb | Re |
|---|---|---|---|---|---|---|---|---|---|---|---|---|---|---|---|---|---|
| Example | Sample 1 | Balance | 0.05 | Less than 0.01 | Less than 0.01 | 23.12 | 1.52 | 1.74 | 9.15 | 12.5 | 0.25 | 0.32 | 0.0041 | 0.0008 | 0 | 0 | 0.5 |
| | Sample 2 | Balance | 0.047 | Less than 0.01 | Less than 0.01 | 23.52 | 1.58 | 1.71 | 9.19 | 12.7 | 0.24 | 0.33 | 0.0029 | 0.0005 | 0 | 0 | 2.9 |
| | Sample 3 | Balance | 0.051 | Less than 0.01 | Less than 0.01 | 23.2 | 1.55 | 1.72 | 9.05 | 12.49 | 0.25 | 0.35 | 0.0038 | 0.0012 | 0.11 | 0 | 2.8 |
| | Sample 4 | Balance | 0.049 | Less than 0.01 | Less than 0.01 | 23.38 | 1.58 | 1.77 | 9.19 | 12.73 | 0.24 | 0.33 | 0.0031 | 0.0006 | 0.69 | 0 | 2.8 |
| | Sample 5 | Balance | 0.052 | Less than 0.01 | Less than 0.01 | 22.58 | 1.48 | 1.75 | 9.2 | 12.28 | 0.24 | 0.32 | 0.0019 | 0.001 | 0 | 0.07 | 2.8 |
| | Sample 6 | Balance | 0.051 | Less than 0.01 | Less than 0.01 | 23.27 | 1.57 | 1.77 | 9.21 | 12.73 | 0.24 | 0.34 | 0.0032 | 0.0008 | 0 | 0.35 | 2.8 |
| | Sample 7 | Balance | 0.05 | Less than 0.01 | Less than 0.01 | 23.4 | 1.59 | 1.78 | 9.23 | 12.72 | 0.24 | 0.33 | 0.0032 | 0.0005 | 0.1 | 0.25 | 2.9 |
| Comparative Example | Sample 8 | Balance | 0.095 | Less than 0.01 | Less than 0.01 | 22.43 | 1.46 | 1.28 | 9.09 | 12.29 | 0.23 | 0.3 | 0.003 | 0.0008 | 0 | 0 | 0 |

In the tensile strength test, the Ni-base alloys of Sample 1 to Sample 8 having the chemical compositions shown in Table 1 each in 20 kg were melted in a vacuum induction melting furnace to produce ingots. The ingots were undergone a soaking treatment at 1050° C. for five hours. They were forged at a temperature range of 950 to 1100° C. (reheating at 1100° C.) and subjected to a solution treatment at 1180° C. for four hours. And, test specimens having a predetermined size were produced from the produced forged steels.

The test specimens of the samples were measured for 0.2% proof stress by performing a tensile strength test under temperature conditions of 23° C., 700° C. and 800° C. according to JIS G 0567 (method of high-temperature tensile test for ferrous materials and heat-resistant alloys). The temperature conditions of 700° C. and 800° C. in the tensile strength test were determined considering the temperature conditions in normal operation of a turbine rotor of a steam turbine and the temperatures in anticipation of a safety ratio.

The respective samples were evaluated for forgeability. For evaluation of forgeability, the Ni-base alloys of Sample 1 to Sample 8 having the chemical compositions shown in Table 1 each in 20 kg were melted in a vacuum induction melting furnace, and cylindrical ingots having a diameter of 114 mm and a length of 200 mm were produced. The ingots were undergone a soaking treatment at 1050° C. for five hours. They were forged by a 500-kgf hammer forging machine at a temperature range of 950 to 1100° C. (reheating at 1100° C.), and a solution treatment was performed at 1180° C. for four hours to produce test specimens. For the forgeability, the above-described forging treatment was performed until a forging ratio became 3. The forgeability was evaluated based on to the number of reheating steps until the forging ratio became 3 and the presence or not of a forging crack when the forging ratio became 3.

The forging ratio is defined by the division of a sectional area of an object to be forged vertical to a direction that the object to be forged is stretched before the forging treatment by a sectional area of the forged object vertical to a direction that the forged object is stretched after the forging treatment. According to the ordinary forging treatment, if the temperature of the forged object lowers, namely if the forged object becomes hardened, the forging treatment is repeated by reheating. The number of reheating steps is the number of times that the forged object is reheated in the forging treatment until the forging ratio becomes 3. And, for the presence or not of a forging crack, the forged object undergone the forging treatment is visually checked. If there is no crack, it is indicated as "None", and the forgeability is evaluated as "o" to indicate that the forgeability is excellent. Meanwhile, if there is a crack, it is indicated as "Yes", and the forgeability is evaluated as "x" to indicate that the forgeability is inferior.

Table 2 shows results obtained by measuring the respective samples for 0.2% proof stress and results obtained by evaluating the forgeability.

TABLE 2

| | | 0.2% proof stress, MPa | | | Forgeability evaluation (Forging ratio = 3) | | |
|---|---|---|---|---|---|---|---|
| | | 23° C. | 700° C. | 800° C. | Number of Reheating | Forging crack | Forgeability |
| Example | Sample 1 | 425 | 350 | 326 | 10 | NONE | ○ |
| | Sample 2 | 435 | 382 | 349 | 10 | NONE | ○ |
| | Sample 3 | 428 | 366 | 353 | 10 | NONE | ○ |
| | Sample 4 | 429 | 378 | 358 | 10 | NONE | ○ |
| | Sample 5 | 424 | 369 | 350 | 10 | NONE | ○ |
| | Sample 6 | 426 | 370 | 352 | 10 | NONE | ○ |
| | Sample 7 | 430 | 380 | 355 | 10 | NONE | ○ |
| Comparative Example | Sample 8 | 330 | 265 | 252 | 10 | NONE | ○ |

As shown in Table 2, it was found that Sample 1 to Sample 7 had high 0.2% proof stress at respective temperatures in comparison with the conventional steel of Sample 8. It was also found that their forgeability was excellent, indicating that the forgeability of the conventional steel was maintained. It is presumed that Sample 1 to Sample 7 had a high value of 0.2% proof stress because precipitation strengthening and solid-solution strengthening were promoted. Since the conventional steel of Sample 8 had low mechanical strength, a result satisfying both the mechanical strength and the forgeability was not obtained.

(Gleeble Test)

It is described below that the Ni-base alloy with the chemical composition ranges of the present invention has excellent hot workability. The respective samples shown in Table 1 were subjected to Gleeble test (common test method in the steel industry).

Table 3 shows the results of the Gleeble test on the above-described respective samples. FIG. 1 is a diagram showing the results of the Gleeble test on the respective samples shown in Table 3. The cross-sectional area reduction rate (reduction of area) shown on the vertical axis of FIG. 1 means a ratio of the cross-sectional area of a portion of the tested (ruptured) test specimen reduced from the cross-sectional area before the test to the cross-sectional area of the test specimen before the test. Namely, if the above value is large, it means that the hot workability is excellent.

[Table 3]

TABLE 3

| Test | Reduction of area, % | | | | | | | |
|---|---|---|---|---|---|---|---|---|
| temperature, ° C. | Sample 1 | Sample 2 | Sample 3 | Sample 4 | Sample 5 | Sample 6 | Sample 7 | Sample 8 |
| 900 | 48 | 46 | 43 | 46 | 45 | 44 | 45 | 49 |
| 1000 | 60 | 58 | 57 | 59 | 56 | 57 | 57 | 63 |
| 1100 | 69 | 67 | 67 | 68 | 67 | 66 | 65 | 70 |
| 1200 | 82 | 79 | 78 | 79 | 80 | 81 | 81 | 81 |
| 1300 | 94 | 91 | 89 | 91 | 90 | 89 | 90 | 93 |

As shown in Table 3 and FIG. 1, substantially the same Gleeble test results were obtained between Samples 1 to 7 of the Ni-base alloys having the chemical composition ranges of the present invention and Sample 8 of the Ni-base alloy of the conventional steel at a temperature range of 900 to 1300° C. including the forging temperature range (about 950 to 1150° C.). Thus, it was found that good hot workability could be obtained for the Ni-base alloy having the chemical composition ranges of the present invention similar to the Ni-base alloy of the conventional steel.

(Aging Characteristics)

It is described below that mechanical strength can be maintained even when the Ni-base alloy having the chemical composition ranges of the present invention is maintained at a high temperature for a predetermined time.

Similar to the method of producing the test specimens in the above-described tensile strength test, the Ni-base alloys of Sample 1 to Sample 7 having the chemical compositions shown in Table 1 each in 20 kg were melted in a vacuum induction melting furnace to produce ingots. The ingots were undergone a soaking treatment at 1050° C. for five hours. Then, they were forged at a temperature range of 950 to 1100° C. (reheating at 1100° C.), and a solution treatment was performed at 1180° C. for four hours. Test specimens having a predetermined size were produced from the produced forged steels.

The respective produced test specimens were maintained at 750° C. for 2000 hours, subjected to a tensile strength test under a condition of 700° C. according to JIS G 0567 (method of high-temperature tensile test for ferrous materials and heat-resistant alloys) and measured for 0.2% proof stress. The respective test specimens before the heat treatment were subjected to a tensile strength test under a condition of 700° C. and measured for 0.2% proof stress. The test specimens were maintained at 750° C. because the maximum use temperature of the above-described turbine rotor was taken into consideration in order to obtain safety data. Meanwhile, the temperature condition of 700° C. in the tensile strength test was determined considering the temperature conditions when the turbine rotor of a steam turbine is operated normally.

Table 4 shows the results of measuring the 0.2% proof stress of the respective samples.

TABLE 4

| | 0.2% proof stress, MPa | |
|---|---|---|
| | Before heat treatment | After maintenance at 700° C. for 2000 hr |
| Sample 1 | 350 | 307 |
| Sample 2 | 382 | 312 |
| Sample 3 | 366 | 324 |
| Sample 4 | 378 | 352 |
| Sample 5 | 369 | 340 |
| Sample 6 | 370 | 348 |
| Sample 7 | 380 | 351 |

As shown in Table 4, it was found that the 0.2% proof stress of the test specimens after the heat treatment was reduced slightly, but the mechanical strength before the heat treatment was maintained substantially. Thus, it is presumed that there is substantially no texture change with time.

Although the invention has been described above by reference to the embodiments of the invention, the invention is not limited to the embodiments described above. It is to be understood that modifications and variations of the embodiments can be made without departing from the spirit and scope of the invention.

What is claimed is:

1. An Ni-base alloy for a turbine rotor of a steam turbine, the Ni-base alloy comprises in percent by weight C: 0.01 to 0.15, Cr: 15 to 28, Co: 10 to 15, Mo: 8 to 12, Al: more than 1.5 and 2 or less, Ti: 0.1 to 0.6, B: 0.001 to 0.006, Re: more than 0.5 and 3 or less, Fe: 1.46 to 1.59, and the balance of Ni and unavoidable impurities.

2. The Ni-base alloy for a turbine rotor of a steam turbine according to claim 1, wherein the unavoidable impurities are suppressed in percent by weight to Si: 0.1 or below and Mn: 0.1 or below.

3. A turbine rotor configured to dispose through a steam turbine into which high-temperature steam is introduced, wherein at least a predetermined portion is formed of the Ni-base alloy for a turbine rotor of a steam turbine according to claim 1.

4. The Ni-base alloy for a turbine rotor of a steam turbine according to claim 1, wherein the alloy has a 0.2% proof stress in a range of from 424 to 435 MPa at a temperature at 23° C., from 350 to 382 MPa at 700 ° C. and from 326 to 358 MPa at 800° C.

5. An Ni-base alloy for a turbine rotor of a steam turbine, the Ni-base alloy comprises in percent by weight C: 0.01 to 0.15, Cr: 15 to 28, Co: 10 to 15, Mo: 8 to 12, Al: more than 1.5 and 2 or less, Ti: 0.1 to 0.6, B: 0.001 to 0.006, Ta: 0.1 to 0.7, Re: more than 0.5 and 3 or less, Fe: 1.46 to 1.59, and the balance of Ni and unavoidable impurities.

6. The Ni-base alloy for a turbine rotor of a steam turbine according to claim 5, wherein the unavoidable impurities are suppressed in percent by weight to Si: 0.1 or below and Mn: 0.1 or below.

7. A turbine rotor configured to dispose through a steam turbine into which high-temperature steam is introduced, wherein at least a predetermined portion is formed of the Ni-base alloy for a turbine rotor of a steam turbine according to claim 5.

8. The Ni-base alloy for a turbine rotor of a steam turbine according to claim 5, wherein the alloy has a 0.2% proof stress in a range of from 424 to 435 MPa at a temperature at 23° C., from 350 to 382 MPa at 700 ° C. and from 326 to 358 MPa at 800° C.

9. An Ni-base alloy for a turbine rotor of a steam turbine, the Ni-base alloy comprises in percent by weight C: 0.01 to 0.15, Cr: 15 to 28, Co: 10 to 15, Mo: 8 to 12, Al: more than 1.5 and 2 or less, Ti: 0.1 to 0.6, B: 0.001 to 0.006, Nb: 0.05 to 0.35, Re: more than 0.5 and 3 or less, Fe: 1.46 to 1.59, and the balance of Ni and unavoidable impurities.

10. The Ni-base alloy for a turbine rotor of a steam turbine according to claim 9, wherein the unavoidable impurities are suppressed in percent by weight to Si: 0.1 or below and Mn: 0.1 or below.

11. A turbine rotor configured to dispose through a steam turbine into which high-temperature steam is introduced, wherein at least a predetermined portion is formed of the Ni-base alloy for a turbine rotor of a steam turbine according to claim 9.

12. The Ni-base alloy for a turbine rotor of a steam turbine according to claim 9, wherein the alloy has a 0.2% proof stress in a range of from 424 to 435 MPa at a temperature at 23° C., from 350 to 382 MPa at 700 ° C. and from 326 to 358 MPa at 800° C.

13. An Ni-base alloy for a turbine rotor of a steam turbine, the Ni-base alloy comprises in percent by weight C: 0.01 to 0.15, Cr: 15 to 28, Co: 10 to 15, Mo: 8 to 12, Al: more than 1.5 and 2 or less, Ti: 0.1 to 0.6, B: 0.001 to 0.006, Ta+2Nb: 0.1 to 0.7, Re: more than 0.5 and 3 or less, Fe: 1.46 to 1.59, and the balance of Ni and unavoidable impurities, a molar ratio of Ta to Nb being 1:2.

14. The Ni-base alloy for a turbine rotor of a steam turbine according to claim 13, wherein the unavoidable impurities are suppressed in percent by weight to Si: 0.1 or below and Mn: 0.1 or below.

15. A turbine rotor configured to dispose through a steam turbine into which high-temperature steam is introduced, wherein at least a predetermined portion is formed of the Ni-base alloy for a turbine rotor of a steam turbine according to claim 13.

16. The Ni-base alloy for a turbine rotor of a steam turbine according to claim 13, wherein the alloy has a 0.2% proof stress in a range of from 424 to 435 MPa at a temperature at 23° C., from 350 to 382 MPa at 700 ° C. and from 326 to 358 MPa at 800° C.

* * * * *